United States Patent [19]

Claude

[11] Patent Number: 4,967,402

[45] Date of Patent: Oct. 30, 1990

[54] SEALED WATCHCASE

[76] Inventor: Georges Claude, 107bis, rue du Parc, Ch-2301 La Chaux-de-Fonds, Switzerland

[21] Appl. No.: 307,838

[22] Filed: Feb. 7, 1989

[30] Foreign Application Priority Data

Feb. 8, 1988 [CH] Switzerland ..... 437/88

[51] Int. Cl.[5] ..... G04B 37/00

[52] U.S. Cl. ..... 368/280; 368/300; 368/309

[58] Field of Search ..... 368/88, 276, 280, 285, 368/294–296, 299–300, 309

[56] References Cited

U.S. PATENT DOCUMENTS

| | | | |
|---|---|---|---|
| 309,158 | 12/1884 | O'Hara . | |
| 2,252,647 | 8/1941 | Schmitz | 368/294 |
| 3,952,499 | 4/1976 | Reisman | 368/276 |
| 4,241,442 | 12/1980 | Grohoski | 368/300 |
| 4,529,323 | 7/1985 | Gagnebin | 368/300 |
| 4,544,284 | 10/1985 | Geiger et al. | 368/309 |
| 4,620,798 | 11/1986 | Scarzini | 368/294 |
| 4,692,033 | 9/1987 | Mock et al. | 368/280 |

FOREIGN PATENT DOCUMENTS

| | | | |
|---|---|---|---|
| 041481 | 6/1981 | European Pat. Off. . | |
| 064951 | 5/1982 | European Pat. Off. . | |
| 150746 | 1/1985 | European Pat. Off. . | |
| 1223313 | 8/1966 | Fed. Rep. of Germany . | |
| 2753447 | 11/1977 | Fed. Rep. of Germany . | |
| 188661 | 1/1936 | Switzerland | 368/285 |
| 325874 | 1/1958 | Switzerland . | |

*Primary Examiner*—Vit W. Miska

*Attorney, Agent, or Firm*—Flynn, Thiel, Boutell, & Tanis

[57] ABSTRACT

A sealed watchcase includes a middle-and-bezel having two concentric annular parts which are held one inside the other by means of friction. The internal part of these two parts is a rigid ring made of ordinary metal or plastic. The external part of these two parts is made of precious-metal and forms a thin casing covering at least the radially external surfaces of the rigid ring. A glass part is bonded inside an internal snap in the precious-metal casing. A back cover is held against a bottom flat surface of the middle-and-bezel by fixing screws which are screwed into the rigid ring and ensure, when tightened, clamping of a fitting ring inserted together with a watch movement into the opening of the rigid ring. Seals are compressed between the back cover and the middle-and-bezel. Only the back cover, the precious-metal casing and the glass form the external parts of the watchcase. As a result of this structure, it is possible to make ultra-flat precious-metal cases requiring only a minimum amount of precious metal.

12 Claims, 1 Drawing Sheet

SEALED WATCHCASE

FIELD OF THE INVENTION

The present invention relates to a sealed watchcase and, more particularly, to a sealed watchcase having a middle-and-bezel to which is fixed a glass and, by means of fixing screws, a back cover, and which accommodates a fitting ring serving to position and fix a movement inside the case.

BACKGROUND OF THE INVENTION

One object of the invention is to provide a sealed watchcase of this type, which is very flat, very light and sealed by a reliable system and which, in particular, results in significant savings in precious metal when it is made as a platinum or gold case in accordance with the regulations governing the use of precious metals for watchcases. These regulations stipulate, in fact, in such an instance, that all the external metal parts of such a case must be made of precious metal.

SUMMARY OF THE INVENTION

This and other objects of the invention are achieved by providing a sealed watchcase in which the middle-and-bezel includes two concentric annular parts, one being held inside the other by friction, the internal part of these two parts being a rigid ring preferably made of ordinary metal or plastic, and the external part of these two parts being made of precious metal and forming a casing covering at least the radially external surfaces of the rigid ring. The rigid ring has a peripheral shoulder which rests in an internal notch provided in the precious-metal casing, wherein the glass is bonded inside an internal notch provided in the precious-metal casing, and the back cover is held against a flat bottom surface of the middle-and-bezel by fixing screws which are screwed into the rigid ring and which ensure, when tightened, clamping of the fitting ring and watch movement in the opening in the rigid ring and compression of a seal provided between the back cover and the middle-and-bezel, only the back cover, precious-metal casing, and glass forming external parts of the watchcase.

These features ensure that the external part of the two parts forming the middle-and-bezel, and hence the casing, does not have to absorb any forces. Consequently, it may be designed using a minimum amount of material, thereby resulting in a considerable reduction, up to 60 to 70%, in the amount of precious metal used, compared to conventional monopiece structures known hitherto. However, all the technical advantages of a case with a screw-on type back cover, notably easy access, even to an unskilled person, so that the battery can be changed where the case accommodates a quartz movement, are retained.

The amount of precious metal used may be reduced still further by employing a back cover which includes a precious metal ring, the opening of which is closed by a plate made of glass or other non-metallic material.

The use of offset seats formed in the bottom surface of the middle-and-bezel so as to receive seals which are compressed inside these seats by tightening the fixing screws results in a further reduction in thickness of the watchcase compared to the known designs with seals interposed between the back cover and the middle-and-bezel.

BRIEF DESCRIPTION OF THE DRAWINGS

Exemplary embodiments of the invention are described below with reference to the accompanying drawing, in which.

DETAILED DESCRIPTION

Figure 1:
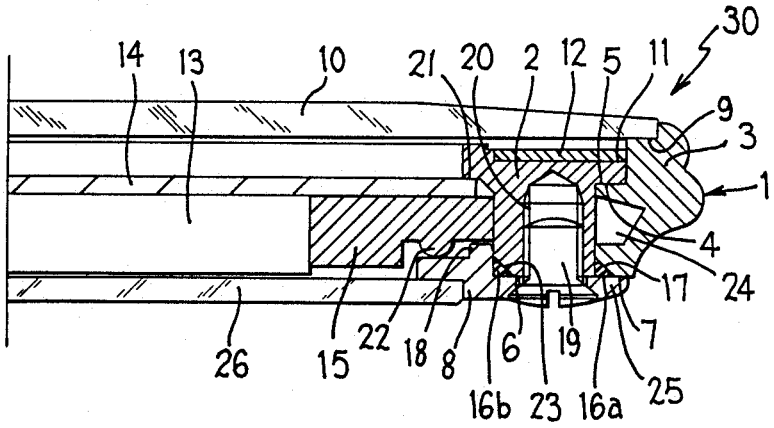
FIG. 1 is a partially sectioned side view of a first embodiment of a watchcase according to the invention.

The sealed watchcase 30 according to each of the two exemplary embodiments shown in the drawing has a middle-and-bezel indicated in its entirety by 1. This middle-and-bezel 1 includes two concentric annular parts 2 and 3 fitted one inside the other by means of friction engagement. The internal part of these two parts is a rigid ring 2 which may be made of ordinary metal or plastic. On the other hand, the external part of the two parts forming the middle-and-bezel 1 is made of precious metal, for example gold or platinum, and forms a casing 3 covering the radially external surfaces on the periphery of the rigid ring 2.

The precious-metal casing 3 has in its inner surface an annular notch or groove 4 having an upwardly facing surface on which rests the bottom surface of a radially projecting flange or peripheral shoulder 5 of the rigid ring 2 so as to prevent the latter from sliding axially downward inside the casing 3. In the position where the parts 2 and 3 are correctly fitted together, such as that shown in the drawing, flat bottom surfaces 6 and 7 of the rigid ring 2 and the casing 3, respectively, are in the same plane and serve as a support for the back cover 8 of the watchcase 30, as will be seen further below.

A second annular notch or groove 9 is formed at the top end of the casing 3 so as to receive a glass plate 10 which is bonded thereto so as to close in a sealed manner the top opening of the middle-and-bezel 1, while increasing the rigidity of the glass/casing assembly. It is obvious that the rigid ring 2 is inserted inside the casing 3 before the glass 10 is fixed thereto, thus providing the casing 3 with the necessary degree of rigidity for bonding to the glass 10. Owing to the presence of the notch 4 and the shoulder 5, the rigid ring 2 can only be inserted via the top opening of the casing 3.

The top surface 11 of the rigid ring 2, which is visible through the glass 10, may be decorated, for example with a layer of metal, or it may be concealed. In the example in FIG. 1, the top surface 11 of the rigid ring 2, otherwise visible through the glass 10, is concealed by a decorative ring or opaque decorative layer 12 which may be designed as a clock face and may be located in a suitable seat or recess in the middle-and-bezel 1. In the example of FIG. 2, the decorative rigid ring, indicated here by **12*a*, is bonded to the bottom face of the glass 10** or is formed as one piece therewith. It may be made of sapphire, ceramic or a precious metal.

At this point of the assembly process, a movement 13 provided with a dial 14 may be placed inside the case 30 via the bottom opening of the middle-and-bezel 1. The movement 13 and dial 14 are positioned inside the watchcase 30 in a known manner with the aid of a fitting ring 15.

Before the case 30 is closed by applying the back cover 8, the seal or seals must be arranged in position. In the two examples shown, two seals are provided in the form of annular rings 16a and 16b with different diameters and triangular cross-sections. One of these rings, indicated by 16a, is positioned so as to project slightly beyond the bottom surface 6, 7 of the middle-and-bezel 1, and in particular is disposed in a seat formed between the radially outwardly facing cylindrical peripheral surface of the rigid ring 2 and an annular skew surface 17 which is inclined upwardly and radially inwardly from the bottom surface 7 of the casing 3. The second seal, denoted by 16b, is positioned around an annular rib 18 of the back cover 8.

Once the seals 16a, 16b have been positioned, the case can be closed by applying the back cover 8, the diameter of which is such that it exceeds the diameter of the internal opening of the casing 3.

The back cover 8 is fixed to the middle-and-bezel 1 by means of fixing screws 19 screwed into tapped holes 20 machined in the rigid ring 2 at angularly spaced locations. Tightening these fixing screws 19 causes the fitting ring 15 to be clamped in position due to the engagement of a surface of the back cover 8 with a portion, in this case a rib 22, of the fitting ring 15, which fitting ring 15 in turn presses the dial 14 against a downwardly facing annular support surface 21 on the rigid ring 2.

At the same time, tightening the fixing screws 19 presses the top surface of the external edge of the back cover 8 against the bottom surfaces 6 and 7 of the rigid ring 2 and the casing 3, respectively, while compressing at the same time the seals 16a, 16b, the seal 16b being compressed against a seat disposed inside a space formed between an annular skew surface 23 of the rigid ring 2 (similar to the skew surface 17 of the casing 3) and a cylindrical radially outwardly facing surface on the rib 18 of the back cover 8.

It will be noted that, as result of the intended arrangement of the seals 16a and 16b in the seats which are axially offset relative to the surfaces 6 and 7 against which the back cover 8 is applied, the thickness of the case 30 described can be further reduced.

The casing 3 may be further lightened by providing recesses 24 in its internal surface, thereby making it possible to reduce further the weight and the amount of precious metal used, without the external appearance of the watchcase 30 being affected as a result.

Figure 2:
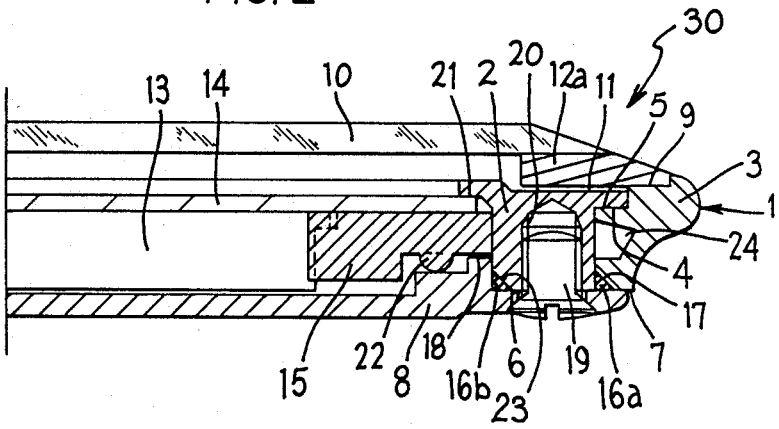
FIG. 2 is a partially sectioned view similar to that of FIG. 1 but showing a second embodiment of the invention.

Another way of reducing the amount of precious metal used, while adhering to the regulations governing precious metals, involves replacing the back cover 8 made entirely from precious metal with a back cover which, as is shown in the example of FIG. 1, includes two parts, namely an external ring 25 made of precious metal, inside the opening of which a plate 26 made of glass or other non-metallic material is bonded.

Although particular preferred embodiments of the invention have been disclosed in detail for illustrative purpose, it will be recognized that variations or modifications of the disclosed apparatus, including the rearrangement of parts, lie within the scope of the present invention.

The embodiments of the invention in which an exclusive property or privilege is claimed are defined as follows:

1. A sealed watchcase, comprising: an annular middle-bezel part which includes an annular outer part and includes an annular inner part disposed concentrically within said outer part in frictional engagement therewith, said inner part being made of a rigid material and said outer part being made of a precious metal; a first cover which has a central portion made of a transparent material and which has a peripheral edge portion bonded to said outer part; a second cover and means for releasably securing said second cover to said inner part; an annular seal compressed between said second cover and one of said inner and outer parts; a movement; and a fitting ring disposed within said inner part and fixedly positioning said movement within said inner part, said inner part being free of contact with said movement; wherein said inner part has a substantially cylindrical and radially outwardly facing surface portion adjacent said second cover, and wherein said outer part has an annular skew surface which, from a location adjacent said cylindrical surface on said inner part and spaced from said second cover part, extends radially outwardly from said inner part and toward said second cover part, said annular seal being disposed between said skew surface on said outer part and said cylindrical surface portion on said inner part.

2. A sealed watchcase as recited in claim 1, wherein said second cover has thereon a surface portion facing said first cover and has a projection of circular cross section which projects outwardly from said surface portion in a direction toward said first cover and which has thereon a radially outwardly facing cylindrical surface; wherein said inner part has thereon an annular skew surface which, from a location adjacent said cylindrical surface on said projection and spaced from said surface portion on said second cover, extends radially outwardly from said projection and toward said surface portion on said second cover; and including a further annular seal encircling said projection and sealingly engaging said cylindrical surface on said projection, said surface portion on said second cover and said skew surface on said inner part.

3. A sealed watchcase as recited in claim 2, wherein said inner part has at an axial end thereof remote from said second cover a radially inwardly projecting flange which has thereon an annular shoulder surface facing said second cover, and including a platelike dial member having peripheral edge portions engaging said shoulder surface on said flange, said movement and said fitting ring being disposed between said dial member and said second cover, said movement having a thickness substantially equal to the distance between said dial member and said second cover, and said fitting ring being firmly clamped between said dial member and said projection on said second cover.

4. A sealed watchcase as recited in claim 3, wherein said inner part has a further annular flange projecting toward said first cover from a radially inner end of said first-mentioned flange, and including an annular platelike part which encircles and has a radially inner edge disposed against said further flange on said inner part and which has a decorative surface on a side thereof facing said first cover.

5. A sealed watchcase as recited in claim 4, wherein said inner part has at an axial end thereof remote from said second cover a radially outwardly projecting flange, said cylindrical surface portion on said inner part extending axially from said second cover to said radially outwardly extending flange, said outer part having a radially inwardly projecting portion having thereon a radially inwardly facing cylindrical surface which frictionally engages said radially outwardly facing cylindrical surface on said inner part, said projection on said outer part having at one axial edge thereof said first-mentioned skew surface and having an opposite axial edge thereof disposed against said radially outwardly projecting flange on said inner part.

6. A sealed watchcase as recited in claim 5, wherein said outer part has therein a plurality of recesses which each extend radially outwardly into said projection of said outer part from said radially inwardly facing cylindrical surface on said projection of said outer part.

7. A sealed watchcase as recited in claim 2, wherein said inner part has a plurality of circumferentially spaced and threaded holes extending thereinto from a surface thereof adjacent said second cover, wherein said second cover has a plurality of holes therethrough which are each aligned with a respective one of said threaded holes in said inner part, and including a plurality of screws which each have a head disposed against a side of said second cover remote from said inner part and a threaded shank extending through a respective hole in said second cover and threadedly engaging a respective threaded hole in said inner part.

8. A sealed watchcase, comprising: an annular middle-bezel part having means for minimizing an amount of a precious metal therein, said means including said middle-bezel part having an annular outer part and an annular inner part disposed concentrically within said outer part in frictional engagement therewith, said inner part being made of a rigid material other than said precious metal and said outer part being made of said precious metal; a first cover which has a central portion made of a transparent material and which has a peripheral edge portion bonded to said outer part; a second cover and means for releasably securing said second cover to said inner part; an annular seal compressed between said second cover and one of said inner and outer parts; a movement; and a fitting ring disposed within said inner part and fixedly positioning said movement within said inner part, said inner part being free of contact with said movement; wherein said means for minimizing the amount of said precious metal in said middle-bezel part includes said outer part having a plurality of recesses which each extend radially outwardly thereinto from a side thereof facing said inner part.

9. A sealed watchcase as recited in claim 8, wherein said outer part has an annular notch therein which receives and is bonded to said peripheral edge portion of said first cover.

10. A sealed watchcase as recited in claim 9, wherein said first cover is a single integral part made entirely of a tranparent material.

11. A sealed watchcase as recited in claim 9, wherein said first cover includes an annular metallic ring which has said peripheral edge portion thereon and includes a further portion which has peripheral edge portion secured to said metallic ring and which is made of a transparent material and includes said central portion of said first cover.

12. A sealed watchcase as recited in claim 8, wherein said inner part has thereon a radially outwardly facing surface portion, and wherein said outer part has thereon a radially inwardly facing surface portion which frictionally engages said radially outwardly facing surface portion on said inner part, said outer part being disposed entirely radially outwardly of said radially outwardly facing surface on said inner part.

* * * * *